US006009746A

United States Patent [19]

Cook et al.

[11] Patent Number: 6,009,746

[45] Date of Patent: Jan. 4, 2000

[54] ELECTRIC-OPERATED TOGGLE LEVER OF LEAK DETECTION MODULE PUMP

[75] Inventors: John E. Cook; Paul D. Perry, both of Chatham, Canada

[73] Assignee: Siemens Canada Ltd., Mississauga, Canada

[21] Appl. No.: 09/107,519

[22] Filed: Jun. 30, 1998

Related U.S. Application Data

[60] Provisional application No. 60/075,953, Feb. 25, 1998.

[51] Int. Cl.[7] ..... F02M 37/04

[52] U.S. Cl. ..... 73/49.7; 73/118.1; 73/40; 123/520

[58] Field of Search ..... 73/40, 49.7, 118.1; 123/520

[56] References Cited

U.S. PATENT DOCUMENTS

| | | | |
|---|---|---|---|
| 5,146,902 | 9/1992 | Cook et al. | 123/518 |
| 5,297,529 | 3/1994 | Cook et al. | 123/520 |
| 5,349,935 | 9/1994 | Mezger et al. | 123/520 |
| 5,383,437 | 1/1995 | Cook et al. | 123/520 |
| 5,411,004 | 5/1995 | Busato et al. | 123/520 |
| 5,460,141 | 10/1995 | Denz et al. | 123/520 |
| 5,467,641 | 11/1995 | Williams et al. | 73/49.7 |
| 5,474,050 | 12/1995 | Cook et al. | 123/520 |
| 5,483,942 | 1/1996 | Perry et al. | 123/520 |
| 5,495,749 | 3/1996 | Dawson et al. | 73/49.7 |
| 5,499,614 | 3/1996 | Busato et al. | 123/520 |
| 5,616,836 | 4/1997 | Blomquist et al. | 73/118.1 |
| 5,635,630 | 6/1997 | Dawson et al. | 73/40.5 R |
| 5,641,899 | 6/1997 | Blomquist et al. | 73/118.1 |
| 5,644,072 | 7/1997 | Chirco et al. | 73/49.2 |
| 5,651,350 | 7/1997 | Blomquist et al. | 123/520 |
| 5,803,056 | 9/1998 | Cook et al. | 123/520 |
| 5,817,925 | 10/1998 | Cook et al. | 73/40 |

*Primary Examiner*—Hezron Williams
*Assistant Examiner*—J. David Wiggins

[57] ABSTRACT

A module for an on-board evaporative emission leak detection system that detects leakage from an evaporative emission space of an automotive vehicle fuel system. A pump disposed within interior space of the module has an inlet in communication with the interior space and an outlet that communicates through a flow passage by with the evaporative emission space. A vent valve within the interior space is selectively operable to a first state that vents the flow passage to the interior space of the module, thereby venting the evaporative emission space to atmosphere, and to a second state that does not vent the flow passage to the interior space. An electromechanical actuator within the interior space operates the pump and the vent valve by respective magnetically responsive levers. For absorbing impact of a lever with stops, an elastomeric part is disposed on an arm of the lever.

21 Claims, 4 Drawing Sheets

ELECTRIC-OPERATED TOGGLE LEVER OF LEAK DETECTION MODULE PUMP

REFERENCE TO RELATED APPLICATION AND PRIORITY CLAIM

This application expressly claims the benefit of earlier filing date and right of priority from the following patent application: U.S. Provisional Application Ser. No. 60/075,953 filed on Feb. 25, 1998 in the names of Cook et al and entitled "ELECTRIC-OPERATED, PUMP-TYPE VAPOR LEAK DETECTION MODULE". The entirety of that earlier-filed, co-pending patent application is hereby expressly incorporated herein by reference.

FIELD OF THE INVENTION

This invention relates generally to a module for an on-board leak detection system that detects fuel vapor leakage from an evaporative emission space of an automotive vehicle fuel system, and more especially to an electric-operated, pump-type module for such a leak detection system.

BACKGROUND OF THE INVENTION

A known on-board evaporative emission control system for an automotive vehicle comprises a vapor collection canister that collects volatile fuel vapors generated in the headspace of the fuel tank by the volatilization of liquid fuel in the tank and a purge valve for periodically purging fuel vapors to an intake manifold of the engine. A known type of purge valve, sometimes called a canister purge solenoid (or CPS) valve, comprises a solenoid actuator that is under the control of a microprocessor-based engine management system, sometimes referred to by various names, such as an engine management computer or an engine electronic control unit.

During conditions conducive to purging, evaporative emission space that is cooperatively defined primarily by intake manifold through the canister purge valve. A CPS-type valve is opened by a signal from the engine management computer in an amount that allows intake manifold vacuum to draw fuel vapors that are present in the tank headspace and/or stored in the canister for entrainment with combustible mixture passing into the engine's combustion chamber space at a rate consistent with engine operation so as to provide both acceptable vehicle driveability and an acceptable level of exhaust emissions.

Certain governmental regulations require that certain automotive vehicles powered by internal combustion engines which operate on volatile fuels such as gasoline, have evaporative emission control systems equipped with an on-board diagnostic capability for determining if a leak is present in the evaporative emission space. It has heretofore been proposed to make such a determination by temporarily creating a pressure condition in the evaporative emission space which is substantially different from the ambient atmospheric pressure, and then watching for a change in that substantially different pressure which is indicative of a leak.

It is believed fair to say that there are two basic types of vapor leak detection systems for determining integrity of an evaporative emission space: a positive pressure system that performs a test by positively pressurizing an evaporative emission space; and a negative pressure (i.e. vacuum) system that performs a test by negatively pressurizing (i.e. drawing vacuum in) an evaporative emission space.

Commonly owned U.S. Pat. No. 5,146,902 discloses a positive pressure system. Commonly owned U.S. Pat. No. 5,383,437 discloses the use of a reciprocating pump to create positive pressure in the evaporative emission space. Commonly owned U.S. Pat. No. 5,474,050 embodies advantages of the pump of U.S. Pat. No. 5,383,437 while providing certain improvements in the organization and arrangement of a reciprocating pump.

SUMMARY OF THE INVENTION

One general aspect of the invention relates to a module for an on-board evaporative emission leak detection system that detects leakage from an evaporative emission space of a fuel system of an automotive vehicle, the module comprising: an enclosure comprising an interior space adapted to be communicated to atmosphere; a pump disposed within the interior space comprising a pumping chamber having an inlet in communication with the interior space and a flow passage for communicating the pumping chamber with an evaporative emission space to allow the evaporative emission space to be pressurized by the pump; a vent valve that is disposed within the interior space and is selectively operable to a first state that vents the flow passage to the interior space to thereby vent the evaporative emission space to atmosphere and to a second state that does not vent the flow passage to the interior space; and an electric-operated actuator mechanism disposed within the interior space for operating the pump and the vent valve to perform a leak test on the evaporative emission space; the mechanism comprising a coupling through which one of the pump and the vent valve is operated, the coupling comprising a lever mounted for pivotal motion about a pivot axis, the lever comprising a lever arm; a stop that defines a limit of pivotal motion of the lever about the pivot axis; and an elastomeric element for absorbing impact of the lever arm with the stop.

Within the foregoing general aspect, some of the more specific aspects relate to: the elastomeric element being disposed on the lever arm; the lever arm comprising a through-hole pattern via which the elastomeric element is disposed on the lever arm; the through-hole pattern comprising a central through-hole and at least one additional through-hole spaced radially from the central through-hole, and the elastomeric element comprises a central hub disposed in the central through-hole and a formation disposed in the at least one additional through-hole; the elastomeric element comprising a rim extending around the perimeter of the central through-hole, a snubber projecting axially from the central hub out of the central through-hole, and plural spaced-apart radial formations joining the central hub and the rim; the snubber comprising a rounded distal end; the plural radial formations being spaced apart in a symmetric pattern about the central hub; a second snubber projecting from the central hub out of the central through-hole in the opposite axial direction from the first snubber; the lever arm further comprising a counterbore that envelopes the through-hole pattern, and the elastomeric element comprising a formation that occupies the counterbore and that joins with the formation disposed in the at least one additional through-hole; the at least one additional through-hole comprising two additional through-holes on diametrically opposite sides of the central through-hole, a respective additional formation of the elastomeric element being disposed in a respective one of the two additional through-holes, and the counterbore comprising a central zone that is concentric with the central through-hole and has diametrically opposite ears extending radially to include the two additional through-holes; the elastomeric element comprising respective bumpers extending axially out of respective ears of the counterbore; the snubber extending axially from the central hub out of the central through-hole in the same axial direction as the bumpers, and farther than the bumpers; the electric-operated actuator mechanism including an electromagnet actuator and the stop comprising a surface of the electromagnet actuator; a further stop spaced from the surface of the electromagnet actuator to define an opposite limit of pivotal motion of the lever about the pivot axis, and the elastomeric element being disposed on the lever arm for absorbing impact of the lever arm with both stops.

Another general aspect relates to an electric-operated toggle lever of a leak detection module pump comprising a lever arm having a pivot axis, and an elastomeric impact-absorbing element spaced from the pivot axis, the lever arm comprising a pattern of through-holes which extend between opposite surfaces of the lever arm and via which the elastomeric element is disposed on the lever arm, the through-hole pattern comprising a central through-hole and plural additional through-holes spaced radially from the central through-hole, the elastomeric element comprising a central hub disposed in the central through-hole and respective formations disposed in the respective additional through-holes, and the elastomeric element comprising a rim extending around the perimeter of the central through-hole, plural spaced-apart radial formations joining the central hub and the rim, joining formations disposed on the opposite surfaces of the lever arm joining the rim and the formations disposed in the additional through-holes, bumpers extending from the joining formations away from the additional through-holes in opposite axial directions, and snubbers extending from the hub in opposite axial directions, the snubbers extending farther from the opposite surfaces of the lever arm than the bumpers.

BRIEF DESCRIPTION OF THE DRAWINGS

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
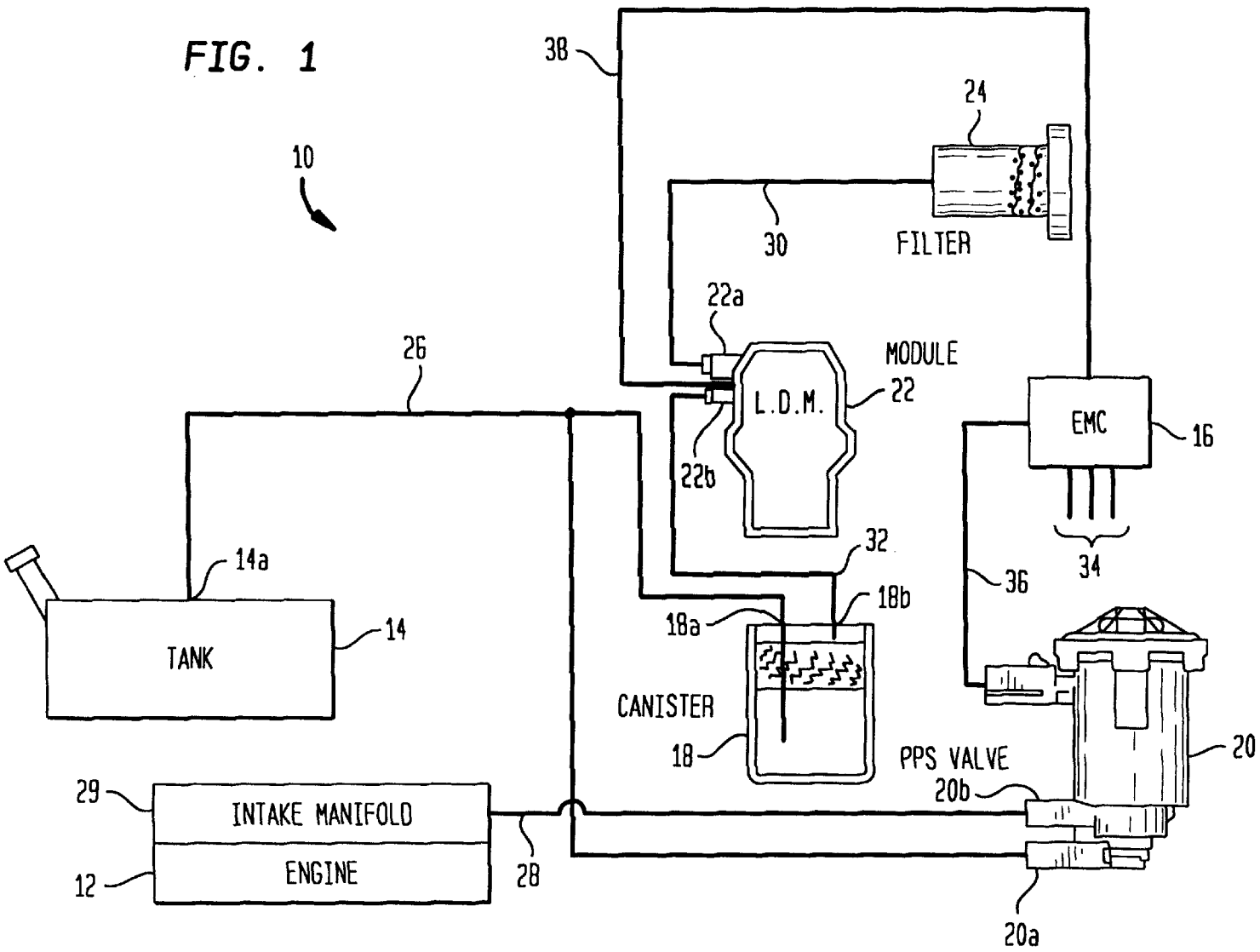
FIG. 1 is a general schematic diagram of an exemplary automotive vehicle evaporative emission control system including a leak detection system and module embodying principles of the invention.

FIG. 1 shows an automotive vehicle evaporative emission control (EEC) system 10 in association with an internal combustion engine 12 that powers the vehicle, a fuel tank 14 that holds a supply of volatile liquid fuel for the engine, and an engine management computer (EMC) 16 that exercises certain controls over operation of engine 12. EEC system 10 comprises a vapor collection canister (charcoal canister) 18, a proportional purge solenoid (PPS) valve 20, a leak detection module (LDM) 22, and a particulate filter 24. In the illustrated schematic, module 22 and canister 18 are portrayed as discrete components, but they could alternatively be integrated into one assembly.

A tank headspace port 14*a* that communicates with headspace of fuel tank 14, a tank port 18*a* of canister 18, and an inlet port 20*a* of PPS valve 20 are placed in common fluid communication by a conduit 26. Another conduit 28 fluid-connects an outlet port 20*b* of PPS valve 20 with an intake manifold 29 of engine 12. Another conduit 30 fluid-connects a port 22*a* of module 22 to atmosphere via filter 24. Another conduit 32 fluid-connects a port 22*b* of module 22 with a vent port 18*b* of canister 18. Headspace of tank 14, canister 18, and associated conduits collectively define evaporative emission space within which fuel vapors generated by volatilization of fuel in tank 14 are temporarily confined and collected until purged to intake manifold 29 via opening of PPS valve 20.

EMC 16 receives a number of inputs, collectively designated 34, (engine-related parameters for example) relevant to control of certain operations of engine 12 and its associated systems, including EEC system 10. One electrical output port of EMC 16 controls PPS valve 20 via an electrical connection 36; other ports of EMC 16 are coupled with module 22 via electrical connections, depicted generally by the reference numeral 38.

From time to time, EMC 16 commands module 22 to an active state as part of an occasional leak detection test procedure for ascertaining the integrity of EEC system 10, particularly the evaporative emission space that contains volatile fuel vapors, against leakage. During occurrences of such a diagnostic procedure, EMC 16 commands PPS valve 20 to close. At times of engine running other than during such leak detection procedures, module 22 reposes in an inactive state, and in doing so provides an open vent path from the evaporative emission space, through itself and filter 24, to atmosphere. A vapor adsorptive medium within canister 18 prevents escape of fuel vapor to atmosphere during such venting.

EMC 16 selectively operates PPS valve 20 such that the valve opens under conditions conducive to purging and closes under conditions not conducive to purging. Thus, during times of operation of the automotive vehicle, the canister purge function is performed in a manner suitable for the particular vehicle and engine so long as the leak detection test procedure is not being performed. When the leak detection test procedure is being performed, the canister purge function is not performed. During a leak detection test, the evaporative emission space is isolated from both atmosphere and the engine intake manifold so that it can be initially positively pressurized by module 22, and the pressure thereafter allowed to decay if leakage is present.

Figure 2:
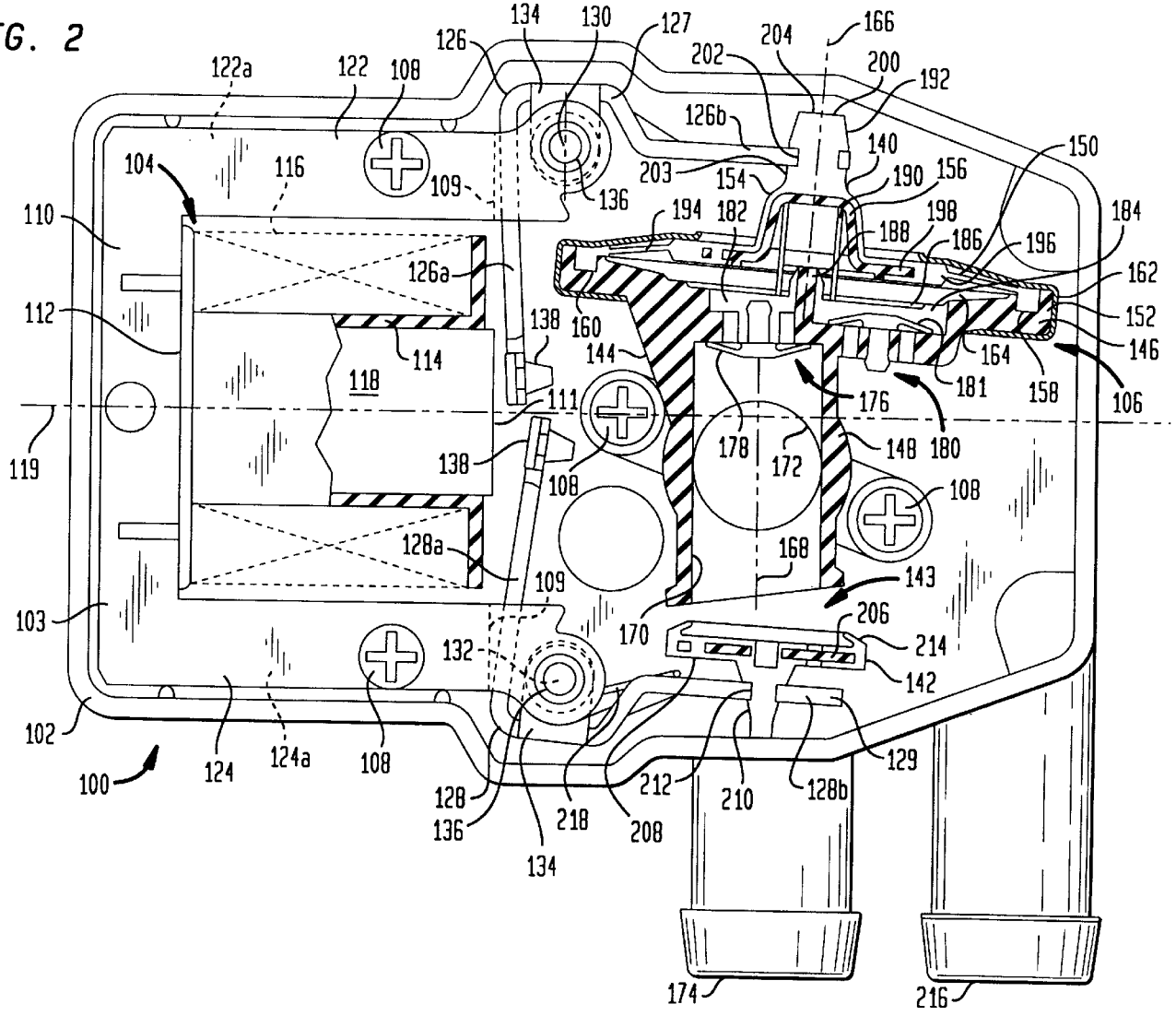
FIG. 2 is a plan view showing the interior of a first embodiment of module.

FIG. 2 discloses a module 100 comprising a walled enclosure 102 that has been opened to reveal the contents of its interior space 103. An electromagnet assembly 104 and a pump assembly 106 are disposed within interior space 103, and each is securely mounted, such as by fastening to an enclosure wall using screws 108 passing through apertures in each assembly.

Electromagnet assembly 104 comprises two non-ferromagnetic retaining plates 110 that are C-shaped as viewed in plan and that sandwich between them a similarly shaped portion of a ferromagnetic core that comprises an E-shaped stack 109 of ferromagnetic laminations. As viewed in plan, E-shaped stack 109 includes three parallel legs, namely two outer legs 122*a*, 124*a*, and a middle leg 111. Electromagnet 112 further comprises a plastic bobbin 114 containing an electromagnet coil 116. Bobbin 114 fits onto middle leg 111 of stack 109 with its axis 119 coincident with middle leg 111. Outer legs 122*a*, 124*a* are sandwiched between corresponding legs 122, 124 of retaining plates 110, and screws 108 pass through them as shown to fasten assembly 104 to enclosure 102. The distal ends of legs 122, 124 comprise respective pivots that serve to mount respective toggle levers 126, 128 for pivotal motion about respective parallel axes 130, 132 that are perpendicular to legs 122, 124.

Each lever 126, 128 comprises a formed ferromagnetic part 127, 129 respectively that places it in magnetic circuit relationship with electromagnet 112. Each part may be considered to have two lever arms that are disposed at approximately right angles to one another. Part 127 of lever 126 comprises lever arms 126*a*, 126*b*, and part 129 of lever 128, lever arms 128*a*, 128*b*. Proximate the proximal ends of its two lever arms, each part 127, 129 comprises a pair of apertured tabs 134 that are bent at right angles to each side of the lever so that the apertured tabs of each pair are disposed mutually parallel and with their circular apertures axially aligned. Each pair of apertured tabs 134 provides for the mounting of the respective lever on the pivot at the distal end of a respective frame leg 122, 124, such as by means of a pivot pin 136.

The distal end of each lever arm 126*a*, 128*a* is disposed proximate an axial end of electromagnet 112 and contains a hole for mounting a respective grommet-like bumper 138. Each bumper 138 comprises a head that faces core 118 and protrudes sufficiently from the respective lever arm that it, rather than the respective lever arm part 127, 129, would abut core 118 when the electromagnet is operated in a manner to be explained later.

The distal ends of lever arms 126*b*, 128*b* are operatively associated with pump assembly 106. The distal end of lever arm 126*b* has a direct connection with a pumping mechanism 140 of pump assembly 106. The distal end of lever arm 128*b* carries a closure 142 that selectively associates with and disassociates from pump assembly 106 to form a vent valve 143.

Pump assembly 106 comprises a housing 144 that is mounted on enclosure 102 by passing screws 108 through apertured tabs at the sides of the housing base. Pumping mechanism 140 is disposed at one end of housing 144, and that end comprises a circular flange 146. Housing 144 further comprises a tubular wall 148 extending from flange 146 to an opposite end of the housing.

Pumping mechanism 140 comprises a movable wall 150 having a circular perimeter margin disposed against a rim 152 of flange 146. Wall 150 is shown to comprise a flexible, but fluid-impermeable, part 154 and a rigid part 156, stamped metal for example. Part 154 is a fuel-tolerant elastomeric material that is molded to part 156 by known insert-molding methods, thereby intimately uniting the two parts 154, 156 into an assembly. The outer perimeter margin of movable wall 150 comprises a circular bead 158 in part 154. Rim 152 comprises a circular groove 160 within which bead 158 is disposed. Bead 158 is held in groove 160 by a circular clinch ring 162 which is fitted over the abutted perimeter margins of wall 150 and flange 146 and which has an outer perimeter that is deformed and crimped onto the abutted perimeter margins of wall 150 and flange 146 in the manner shown. This serves to seal the two perimeter margins together so that a pumping chamber 164 is cooperatively defined by wall 150 and flange 146.

Pumping chamber 164 may be considered to have an axis 166 that is concentric with flange 146 and wall 150. Axis 166 is offset from an axis 168 of tubular wall 148. Tubular wall 148 comprises a passage 170 extending along axis 168 from pumping chamber 164 and opening to the interior space 103 of enclosure 102 at the end of housing 144 opposite pumping chamber 164. Intermediate its opposite ends, passage 170 is intersected by a canister passage 172 that is adapted to be placed in communication with canister 18. Canister passage 172 is formed in enclosure 102 and extends from its intersection with passage 170 to terminate in an external nipple 174 that forms port 22*b* and is available at the exterior of enclosure 102 for association with conduit 32.

A one-way valve 176 is disposed between pumping chamber 164 and passage 170 to allow fluid flow in a direction from pumping chamber 164 into passage 170, but not in an opposite direction. Valve 176 comprises an elastomeric umbrella valve element 178 mounted on an appropriately apertured internal wall of housing 144 that separates pumping chamber 164 from passage 170. Spaced from valve 176 circumferentially about axis 166 is a second one-way valve 180 comprising an umbrella valve element 181. Valve 180 has a construction like that of valve 176, but element 181 is mounted on an external wall of housing 144 to allow fluid flow in a direction from the interior space 103 of enclosure 102 into pumping chamber 164, but not in an opposite direction.

The walls of housing 144 that contain valves 176, 180 comprises respective depressions 182, 184 which are disposed in a housing surface 186 circumferentially spaced about a central post 188 that stands on surface 186 along axis 166. One axial end of a helical coil spring 190 is disposed over post 188 to bear against surface 186. Part 156 is formed to have a central tower 192 disposed over the opposite axial end of spring 190. That axial end of spring 190 bears against an end wall of tower 192.

Part 154 comprises an annulus 194 whose outside diameter (O.D.) joins with bead 158. The inside diameter (I.D.) of annulus 194 joins with a bead 196 that is molded onto the free edge of a flange 198 of part 156 at the base of tower 192. Bead 196 has a thickness as measured in a direction parallel with axis 166 that exceeds the thickness of flange 198, extending beyond the flange in both axial directions. Material of part 154 adheres to part 156 in covering relation to the entirety of the surface of the part that is circumferentially bounded by bead 196 externally of pumping chamber 164.

On the exterior of the end wall of tower 192, part 154 comprises a grommet-like post 200 that projects coaxially of axis 166 away from the tower. Intermediate its axial length, post 200 comprises a groove 202 fitting the post to the margin of a circular hole through the distal end of lever arm 126*b*. Between groove 202 and tower 192, post 200 comprises a bulk of molded elastomeric material 203 of part 154, and to the opposite axial side of groove 202, post 200 comprises a blunt, frusto-conically tapered nose 204 that is shaped to allow lever 126 to be operatively connected to pumping mechanism 140 by inserting nose 204 into and through the circular hole in lever arm 126*b* until groove 202 becomes fitted to the hole's margin. FIG. 2 shows spring 190 resiliently biasing movable wall 150 in a direction axially away from pumping chamber 164 to cause bead 196 to abut a radially inner margin of clinch ring 162 in the manner shown.

Closure 142 comprises a rigid disk 206, stamped metal for example, onto which elastomeric material 208 has been insert molded so that the two are intimately united to form an assembly. The elastomeric material forms a grommet-like post 210 that projects perpendicularly away, and to one axial side of, the center of disk 206. Post 210 comprises an axially central groove 212 providing for the attachment of closure 142 to the distal end of lever arm 128*b* in the same manner as the attachment of lever arm 126*b* to post 200. At the outer margin of disk 206, the elastomeric material is formed to provide a lip seal 214 that is generally frusto-conically shaped and canted inward and away from disk 206 on the axial side of the disk opposite post 210.

Enclosure 102 comprises a second nipple 216 that forms port 22*a* and is available on the enclosure exterior for association with conduit 30. This provides for interior space 103 to be continuously vented to atmosphere through filter 24.

The positions of the various parts of module 100 shown in FIG. 2 represent a condition where module 100 is in its inactive state. In that state, lever 128 is biased clockwise about axis 132 by a torsion spring 218 to cause closure 142 to be spaced apart from housing 144, thereby holding vent valve 143 open. Consequently, the evaporative emission space is vented to atmosphere through a vent path comprising conduit 32, passage 172, passage 170, interior space 103, conduit 30, and filter 24. When a leak detection test is to be performed, EMC 16 operates module 100 to an active state, and PPS valve 20, closed.

In the active state of module 100, electromagnet 112 is energized by a driver circuit to pivot lever 128 counterclockwise from the position shown in FIG. 2, thereby swinging closure 142 over a small acute angle about axis 132 to seal the open end of passage 170 closed due to the action of lip seal 214 with the end surface of housing 144 around passage 170. Consequently, the evaporative emission space under test is no longer vented to atmosphere because the vent path through vent valve 143 has now been closed. The electric current supplied to coil 116 by the driver circuit may be considered to comprise a first component that causes electromagnet 112 to exert a force on lever arm 128*a* that, in conjunction with the force vs. deflection characteristic of torsion spring 218, the inertial mass pivotally mounted about axis 132, and the pressure differential acting on closure 142, maintains closure 142 sealed closed against the end surface of housing 144 around passage 170 while module 100 continues to be in its active state.

The electric current supplied to coil 116 may be considered to also comprise a second component that is effective to cause electromagnet 112 to oscillate, or toggle, lever 126 during the active state of module 100, and thereby operate pumping mechanism 140, while the vent path to atmosphere remains closed. Movable wall 150 executes a pumping stroke, or downstroke, as lever 126 pivots clockwise about axis 130 from the position shown in FIG. 1, due to attraction of lever arm 126*a* toward armature core 118. Such stroking causes a charge of air that is in pumping chamber 164 to be compressed, and thence a portion of the compressed charge expelled through valve 176, into passage 170, into passage 172, and ultimately into the evaporative emission space being tested. The pump downstroke is limited by abutment of bead 196 with surface 186, and when that occurs, the consequent lack of further compression of the air charge prevents valve 176 from remaining open.

Electromagnet 112 then releases lever 126, and the action of spring 190 causes movable wall 150 to execute a charging stroke, or upstroke, in a direction away from pumping chamber 164. During the upstroke, valve 176 remains closed, but a pressure differential across valve 180 causes the latter valve to open. Now atmospheric air from interior space 103 can enter pumping chamber 164 through valve 180. At the end of the upstroke, bead 196 abuts clinch ring 162 at which time a charge of air has once again been created in pumping chamber 164. At that time, valve 180 closes due to lack of sufficient pressure differential to maintain it open. Pumping mechanism 140 is then once again downstroked by electromagnet 112 to commence the next pumping stroke wherein a charge of air is compressed, and a portion of the compressed charge is forced into the evaporative emission space.

Pumping mechanism 140 is repeatedly stroked in this manner until pressure suitable for performing a leak detection test has been created in the evaporative emission space under test. The component of electric current in coil 116 that oscillates, or reciprocally swings, lever 126 has a pulsing, or oscillating, characteristic that is chosen in relation to the inertial mass that is pivoted about axis 130 and the operating characteristic of spring 190 that pumping mechanism 140 can follow the oscillating, or pulsing, current component. Hence, spring 190 is much stiffer than spring 218.

Pressure sensing may be performed by a pressure sensor, or pressure switch, (not specifically illustrated in FIG. 2) disposed in association with enclosure 102. Once pressure suitable for performing a leak detection test has been created in the evaporative emission space under test, a suitable procedure for obtaining a leakage measurement may be may be employed while vent valve 143 and PPS valve 20 remain closed.

The presence of leakage may be detected by sensing loss of pressure in the evaporative emission space under test, for example sensing pressure loss by means of such a pressure sensor, or switch. Such sensor, or switch, may define a switch point corresponding to a pressure suitable for performing a test. When the pressure rises to the switch point, pumping mechanism 140 may be operated in a controlled manner to increase the pressure slightly higher. The controlled manner of operation may be time-based or pulse-based. Pumping mechanism 140 may be stroked a certain number of times and then stopped, remaining stopped until the pressure sensed by the sensor drops to the switch point. For example, twenty strokes at a twenty cycle per second stroke rate would require one second. When the pressure returns to the switch point, the pumping mechanism is again stroked and stopped in the same manner as before to again slightly increase the pressure.

For a stable leak, the testing will stabilize at a condition where pumping mechanism 140 will be stroked at fairly regular intervals. The durations of these intervals between successive strokings of the pumping mechanism are indications of the effective leak size. The larger the leak, the smaller the intervals, and vice versa. Once the intervals have substantially stabilized, they may be averaged to yield a leak measurement. At the conclusion of the test, module 100 is returned to its inactive state by terminating electric current flow to coil 116. At that time lever 128 swings back to the position shown by FIG. 2. Analog and digital sensors are believed suitable for the pressure sensor, and examples of suitable devices are a Motorola 5100 Series Sensor and an MPL (MicroPneumatic Logic) 500 Series Switch.

Figure 3:
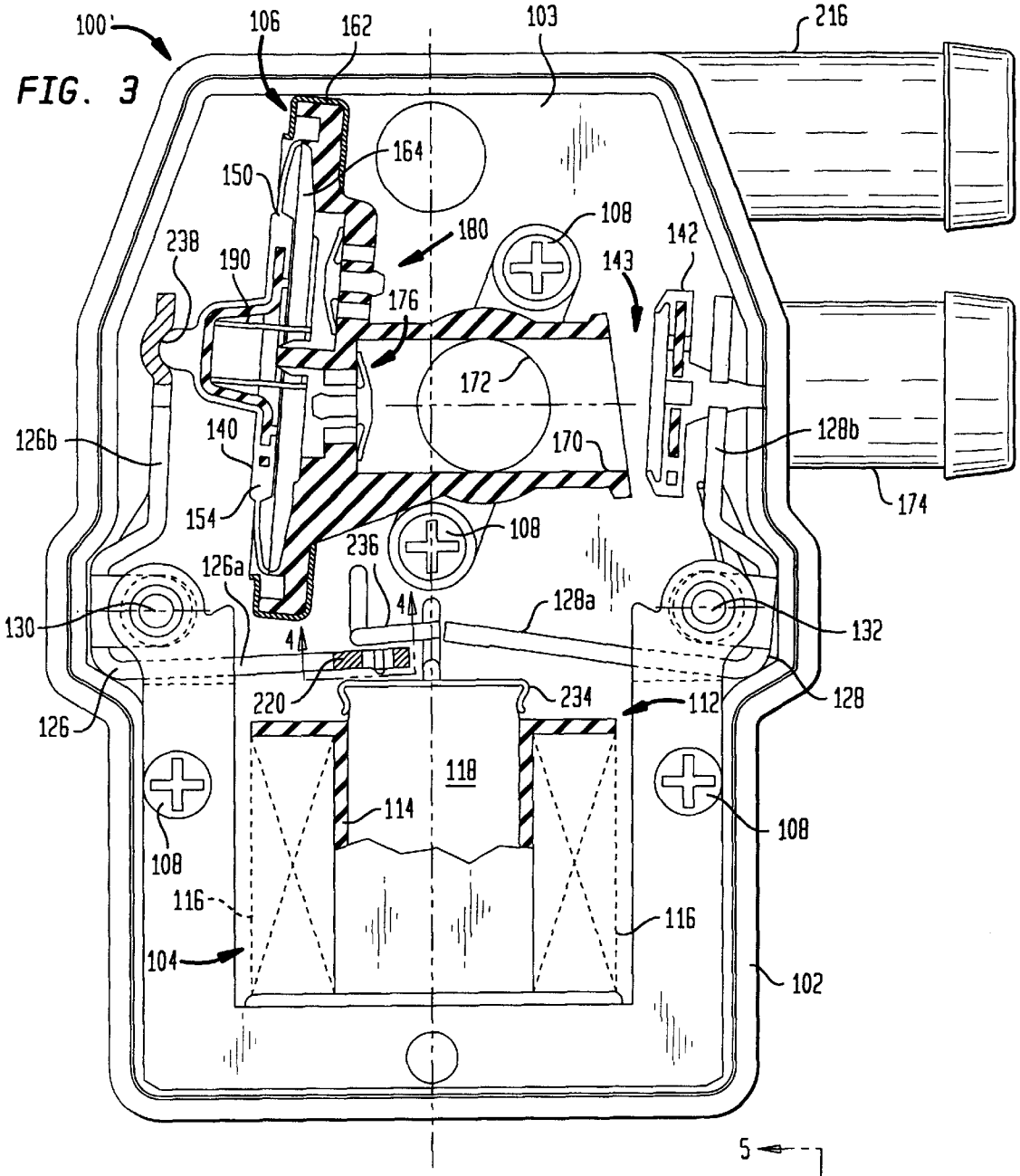
FIG. 3 is a plan view showing the interior of a second embodiment of module.

The module 100' of FIG. 3 is like module 100 of FIG. 2, and the same reference numeral is used in both Figures to designate similar parts. Module 100' differs from module 100 in the following respects.

Figure 5:
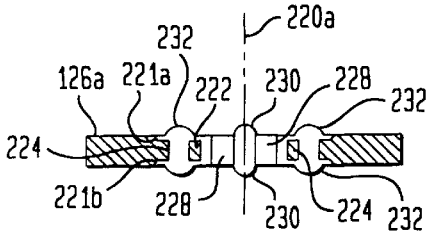
FIG. 5 is a transverse cross section view in the direction of arrows 5—5 in FIG. 4.
Figure 4:
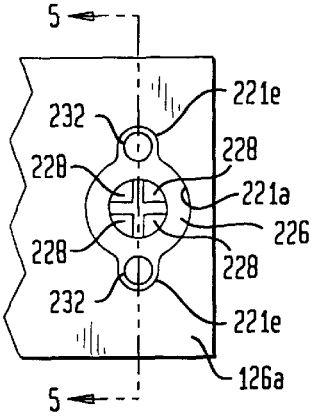
FIG. 4 is an enlarged view in the direction of arrows 4—4 in FIG. 3.

In module 100', no elastomeric part, corresponding to part 138 of module 100, is present on the distal end of lever arm 128*a*, and an elastomeric part 220, different from part 138 of module 100, is present on the distal end of lever arm 126*a*. As shown by FIGS. 4 and 5, the distal end of lever arm 126*a* comprises axially aligned, relatively shallow counterbores 221*a*, 221*b* on opposite sides. The two counterbores are substantially identical in size and shape, each being circular, except for diametrically opposite ears 221*e* that protrude radially beyond the otherwise nominally circular edge. A central circular through-hole 222 and two smaller circular through-holes 224 that are spaced radially outward, and equal distances from the edge, of through-hole 222 extend through the lever arm between the bottoms of the two counterbores 221*a*, 221*b*. The axes of the three through-holes pass through a common diameter of through-hole 222 that is perpendicular to the length of lever arm 126*a*, and that is also shared by ears 221*e* so that each through-hole 224 is centered in a respective ear 221*e*.

Part 220 is intimately joined with lever arm 126*a* by insert molding. Part 220 may be considered to have an imaginary axis 220*a* perpendicular to the length of the lever arm and to comprise a circular rim 226 that radially overlaps the edge of through-hole 222. Portions of rim 226 occupy counterbores 221*a*, 221*b*, and through-holes 224. The portions disposed in through-holes 224 may be considered mounting members, and the portions in counterbore 221*a*, 221*b*, joining members. A radially inner margin of rim 226 occupies an annular volume that forms a radially outer region of through-hole 222.

At its center, part 220 comprises radially inwardly directed formations, or radial members, 228 that merge at a central hub. The illustrated embodiment comprises four such formations that are separated circumferentially by radial slots centered 90° apart about axis 220*a*. The hub includes two substantially identical snubbers 230 that project in opposite axial directions away from the hub along axis 220*a*. Each snubber terminates in a rounded distal end. At each of four locations where rim 226 overlies an end of a through-hole 224, part 220 further comprises a rounded dome forming a bumper 232. Bumpers 232 are substantially identical in size and shape. Each such bumper protrudes axially a certain distance out of its respective counterbore ear 221*e*. FIG. 5 shows that on each side of the lever arm, the corresponding snubber 230 protrudes axially farther than the two corresponding bumpers.

A ferromagnetic cap 234 is fitted over and onto the end of core 118, which protrudes slightly farther out of bobbin 114 than in module 100. A stop 236 is disposed a distance beyond cap 234, and the distal end of lever arm 126*a* is disposed between them. Stop 236 is part of an integral formation that extends from a wall of enclosure 102 within interior space 103.

Pumping mechanism 140 of module 100' has a movable wall 150 that is somewhat different from its FIG. 2 counterpart. In particular, part 154 of module 100' lacks a bead corresponding to bead 196 of module 100, and its post 200 is shorter, has a rounded nose, and lacks a groove 202. Module 100' also comprises a clinch ring 162 that differs from that of module 100 by extending radially inward just far enough to capture bead 158 in groove 160. The action of spring 190 serves to bias post 200 against lever arm 126*b*, seating the rounded nose of the post in the concave face of a dimple 238 formed in the lever arm. This in turn biases lever 126 in the counterclockwise sense about axis 130.

FIG. 3 illustrates a maximum counterclockwise position of lever 126 set by abutment of lever arm 126*a* with stop 236 when electromagnet 112 is not energized. Energization of electromagnet 112 will pivot lever 126 clockwise, down-stroking movable wall 150 in the process. The maximum clockwise limit of pivotal motion is set by abutment of lever arm 126*a* with cap 234. Hence the stroke of movable wall 150 of pumping mechanism 140 is set by the spacing distance between stop 236 and cap 234, rather than by stops built into the pumping mechanism and housing in module 100.

While elastomeric part 138 has been omitted from lever arm 128*a* in module 100', it, or an alternative form, could be included, depending at least to some extent on the loudness of impacting noise of lever arm 128*a* with cap 234 when electromagnet 112 is first energized to operate valve 143 closed. Part 220 is believed to provide certain improvements in attenuation of both impact force and audible noise. When lever 126 rocks back and forth, it is snubbers 230 that initially abut cap 234 and stop 236. When the rounded distal end of a snubber 230 hits, it is believed that the central portion of part 220 begins to deform and become effective to commence decelerating the lever. By the time that a bumper 232 hits, the lever is believed traveling at a speed noticeably less than would otherwise be the case were the corresponding snubber absent. Module 100' is operated in the same manner as module 100 during an evaporative emission space leak test.

Figure 6:
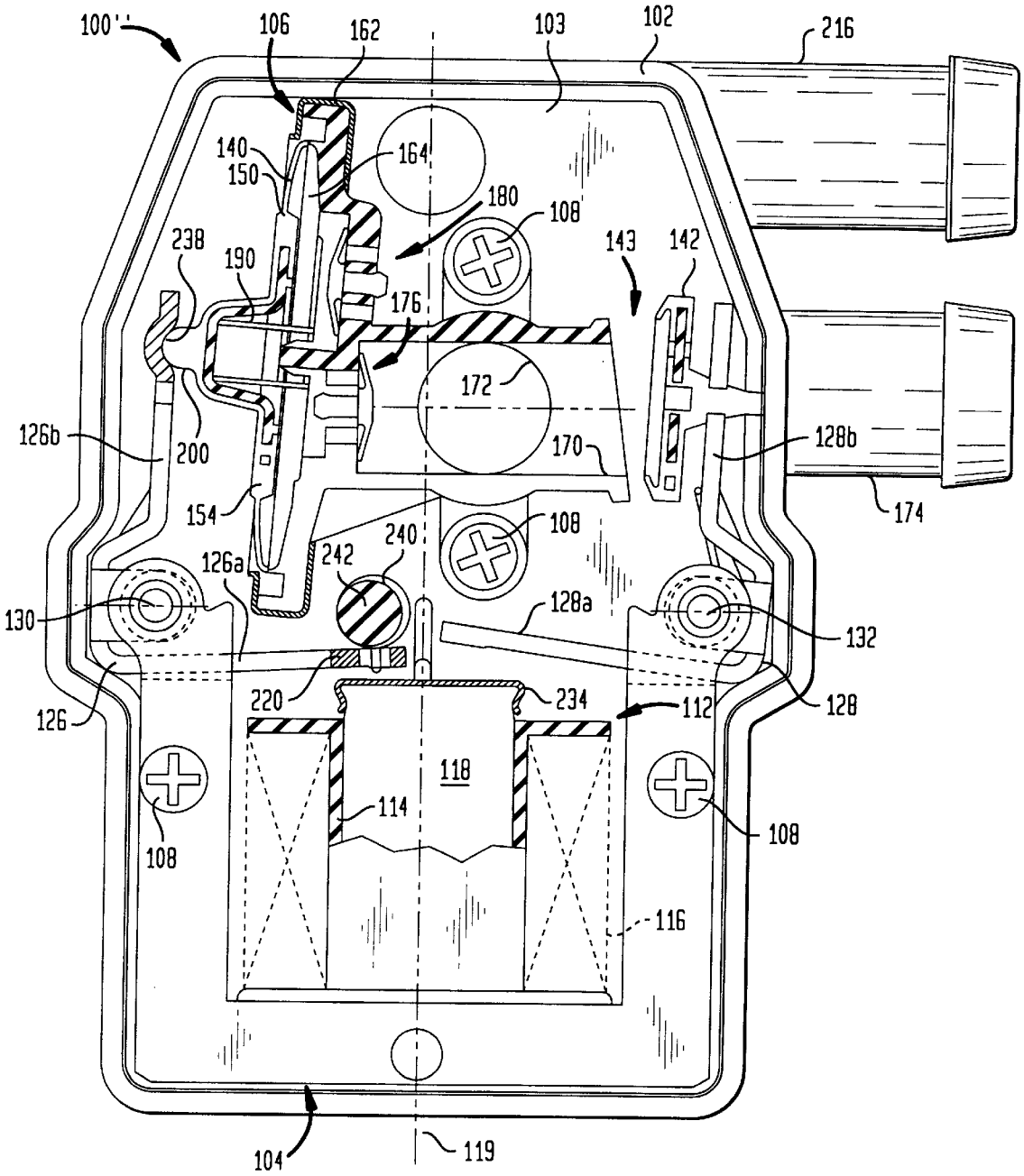
FIG. 6 is a plan view showing the interior of a third embodiment of module.

The module 100" of FIG. 6 is like module 100' of FIG. 3, and the same reference numeral is used in both Figures to designate similar parts. Module 100" differs from module 100' in the following respects.

Module 100" includes an adjustment mechanism for adjusting the stroke of movable wall 150 of pumping mechanism 140. The adjustment mechanism comprises an eccentric cam 240 that replaces stop 236. Eccentric cam 240 is disposed on a shaft that is mounted for turning about an axis 242. Eccentric cam 240 comprises a surface that is eccentric about axis 242 and that is disposed spaced from cap 234 in confrontation of lever arm 126*a*. The shaft that contains eccentric cam 240 comprises a tool engagement surface, a hex socket for example, that can be engaged and rotated by a suitable adjustment tool to similarly rotate eccentric cam 240 about axis 242 to a position where the portion of the eccentric surface that faces cap 234 is set to a desired spacing distance from the cap to produce a desired stroke for movable wall 150 when pumping mechanism is operated by electromagnet 112 acting on lever arm 126.

It is to be understood that because the invention may be practiced in various forms within the scope of the appended claims, certain specific words and phrases that may be used to describe a particular exemplary embodiment of the invention are not intended to necessarily limit the scope of the invention solely on account of such use.

What is claimed is:

1. A module for an on-board evaporative emission leak detection system that detects leakage from an evaporative emission space of a fuel system of an automotive vehicle, the module comprising:

an enclosure comprising an interior space adapted to be communicated to atmosphere;

a pump disposed within the interior space comprising a pumping chamber having an inlet in communication with the interior space and a flow passage for communicating the pumping chamber with an evaporative emission space to allow the evaporative emission space to be pressurized by the pump;

a vent valve that is disposed within the interior space and is selectively operable to a first state that vents the flow passage to the interior space to thereby vent the evaporative emission space to atmosphere and to a second state that does not vent the flow passage to the interior space; and an electric-operated actuator mechanism disposed within the interior space for operating the pump and the vent valve to perform a leak test on the evaporative emission space;

the actuator mechanism comprising a coupling through which one of the pump and the vent valve is operated, the coupling comprising a lever mounted for pivotal motion about a pivot axis, the lever comprising a lever arm;

a stop that defines a limit of pivotal motion of the lever about the pivot axis;

and an elastomeric element for absorbing impact of the lever arm with the stop.

2. A module as set forth in claim 1 in which the elastomeric element is disposed on the lever arm.

3. A module as set forth in claim 2 in which the lever arm comprises a through-hole pattern via which the elastomeric element is disposed on the lever arm.

4. A module as set forth in claim 3 in which the through-hole pattern comprises a central through-hole and at least one additional through-hole spaced radially from the central through-hole, and the elastomeric element comprises a central hub disposed in the central through-hole and a mounting member disposed in the at least one additional through-hole.

5. A module as set forth in claim 4 in which the elastomeric element comprises a rim extending around the perimeter of the central through-hole, a snubber projecting axially from the central hub out of the central through-hole, and plural spaced-apart radial members joining the central hub and the rim.

6. A module as set forth in claim 5 in which the snubber comprises a rounded distal end.

7. A module as set forth in claim 5 in which the plural radial members are spaced apart in a symmetric pattern about the central hub.

8. A module as set forth in claim 5 in which the snubber projects from the central hub in one axial direction, and further including a second snubber which projects from the central hub out of the central through-hole in the opposite axial direction.

9. A module as set forth in claim 4 in which the lever arm further comprises a counterbore that envelopes the through-hole pattern, and the elastomeric element comprises a joining member that occupies the counterbore and that joins with the mounting member.

10. A module as set forth in claim 9 in which the at least one additional through-hole comprises two additional through-holes on diametrically opposite sides of the central through-hole, a respective additional mounting member being disposed in a respective one of the two additional through-holes, and the counterbore comprises a central zone that is concentric with the central through-hole and has diametrically opposite ears extending radially to include the two additional through-holes.

11. A module as set forth in claim 10 in which the elastomeric element comprises respective bumpers extending axially out of respective ears of the counterbore.

12. A module as set forth in claim 11 in which the elastomeric element comprises a rim extending around the perimeter of the central through-hole, plural spaced-apart, radial members joining the central hub and the rim, and a snubber extending axially from the central hub out of the central through-hole in the same axial direction as the bumpers, and farther than the bumpers.

13. A module as set forth in claim 12 in which the lever further comprises a second counterbore that envelopes the through-hole pattern axially opposite the first counterbore, the elastomeric element comprises a further joining member that occupies the second counterbore and that joins with the mounting members, the second counterbore comprises a central zone that is concentric with the central through-hole and has diametrically opposite ears extending radially to include the two additional through-holes, and the elastomeric element comprises respective additional bumpers extending axially out of respective ears of the second counterbore in an axial direction opposite the first bumpers and a second snubber extending axially from the central hub out of the central through-hole in the same axial direction as the additional bumpers, and farther than the additional bumpers.

14. A module as set forth in claim 1 in which the electric-operated actuator mechanism includes an electromagnet actuator and the stop comprises a surface of the electromagnet actuator.

15. A module as set forth in claim 14 including a further stop spaced from the surface of the electromagnet actuator to define an opposite limit of pivotal motion of the lever about the pivot axis, and in which the elastomeric element is disposed on the lever arm for absorbing impact of the lever arm with both stops.

16. A module as set forth in claim 15 in which the lever arm comprises a pattern of through-holes which extend between opposite surfaces of the lever arm and via which the elastomeric element is disposed on the lever arm, the through-hole pattern comprises a central through-hole and plural additional through-holes spaced radially from the central through-hole, the elastomeric element comprises a central hub disposed in the central through-hole and respective mounting members disposed in the respective additional through-holes, and the elastomeric element comprises a rim extending around the perimeter of the central through-hole, plural spaced-apart radial members joining the central hub and the rim, joining members disposed on the opposite surfaces of the lever arm joining the rim and the mounting members, bumpers extending from the joining members away from the additional through-holes in opposite axial directions, and snubbers extending from the hub in opposite axial directions, the snubbers being disposed to abut the stops before the bumpers.

17. A module as set forth in claim 1 further including an electric signaling device communicated to the flow passage for providing an electric signal related to pressure in the evaporative emission space.

18. A module as set forth in claim 1 in which the lever comprises a further lever arm, the pump comprises a movable wall that is reciprocally stroked by toggling of the lever, and a spring resiliently biases the movable wall against the further lever arm so that the movable wall follows toggling of the lever.

19. A module as set forth in claim 18 in which the further lever arm comprises a dimple, the movable wall comprises a post having a rounded end, and the spring resiliently biases the rounded end of the post to seat in the dimple of the further lever arm.

20. An electric-operated toggle lever of a leak detection module pump comprising a lever arm having a pivot axis, and an elastomeric impact-absorbing element spaced from the pivot axis, the lever arm comprising a pattern of through-holes which extend between opposite surfaces of the lever arm and via which the elastomeric element is disposed on the lever arm, the through-hole pattern comprising a central through-hole and plural additional through-holes spaced radially from the central through-hole, the elastomeric element comprising a central hub disposed in the central through-hole and respective mounting members disposed in the respective additional through-holes, and the elastomeric element comprising a rim extending around the perimeter of the central through-hole, plural spaced-apart radial members joining the central hub and the rim, joining members disposed on the opposite surfaces of the lever arm joining the rim and the mounting members, bumpers extending from the joining members away from the additional through-holes in opposite axial directions, and snubbers extending from the hub in opposite axial directions, the snubbers extending farther from the opposite surfaces of the lever arm than the bumpers.

21. An electric-operated toggle lever as set forth in claim 20 in which the opposite surfaces of the lever arm comprises respective counterbores that envelope the through-hole pattern, and the joining members are disposed in the counterbores.

* * * * *